US011583020B2

(12) United States Patent
Kleyman

(10) Patent No.: US 11,583,020 B2
(45) Date of Patent: Feb. 21, 2023

(54) SHIRT STAY WITH SUPPORT CLIP AND METHOD OF USING A SHIRT STAY

(71) Applicant: Roman Kleyman, Hollywood, FL (US)

(72) Inventor: Roman Kleyman, Hollywood, FL (US)

( * ) Notice: Subject to any disclaimer, the term of this patent is extended or adjusted under 35 U.S.C. 154(b) by 277 days.

(21) Appl. No.: 17/014,183

(22) Filed: Sep. 8, 2020

(65) Prior Publication Data

US 2021/0068486 A1 Mar. 11, 2021

Related U.S. Application Data

(60) Provisional application No. 62/897,375, filed on Sep. 8, 2019.

(51) Int. Cl.
*A41F 17/00* (2006.01)
*A41F 5/00* (2006.01)

(52) U.S. Cl.
CPC ..... *A41F 17/00* (2013.01); *A41F 5/00* (2013.01)

(58) Field of Classification Search
CPC . A41F 5/00; A41F 17/00; A41F 17/02; Y10T 24/44444; Y10T 24/44564; Y10T 24/44932
See application file for complete search history.

(56) References Cited

U.S. PATENT DOCUMENTS 668,088 A 2/1901 Bruce
845,743 A 3/1907 Bindner
1,520,739 A * 12/1924 Zetlitz ..... A41B 3/04 24/336
1,547,997 A * 7/1925 Fagerstrom ..... A41F 5/00 24/348
1,563,746 A 12/1925 Hirsch et al.
1,656,671 A 1/1928 Hage
2,014,052 A 9/1935 Obermeyer
D156,659 S 12/1949 Reed
3,331,110 A 7/1967 Allan
4,784,199 A * 11/1988 Wise ..... A45F 5/02 224/230
4,949,432 A * 8/1990 Wisniewski ..... A45C 11/04 24/336

(Continued)

FOREIGN PATENT DOCUMENTS

CH 129272 A * 10/1927
DE 102005047836 A1 5/2007

(Continued)

*Primary Examiner* — F Griffin Hall
(74) *Attorney, Agent, or Firm* — Laurence A. Greenberg; Werner H. Stemer; Ralph E. Locher

(57) ABSTRACT

A shirt stay is provided that includes a Z-shaped or S-shaped double-clip support body providing a dual gripping mechanism that prevents a top garment from becoming untucked, while preventing a bottom garment from slipping down from the waist. The double clip support body includes two permanently interlocked U-shaped spring clips oriented in opposite directions and interchangeable grips arranged on the U-shaped spring clips to adjust the spacing of the springs, and correspondingly, the spring tension, of the U-shaped spring clips. Grips having different characteristics can be interchanged with one another on the support body based on the thickness of, and/or type of, material used for each of the top garment and the bottom garment.

20 Claims, 4 Drawing Sheets

(56) References Cited

U.S. PATENT DOCUMENTS

| | | | | |
|---|---|---|---|---|
| 5,619,774 | A * | 4/1997 | Perry | A45F 5/02 24/336 |
| 6,484,365 | B1 | 11/2002 | Thompson | |
| 7,367,089 | B2 * | 5/2008 | Cooke | A45F 5/021 24/3.12 |
| 8,769,780 | B1 | 7/2014 | Segel | |
| 9,084,448 | B2 | 7/2015 | Keum | |
| 9,144,292 | B2 | 9/2015 | Prestwich | |
| 9,377,161 | B2 | 6/2016 | Hanchett et al. | |
| 2005/0045685 | A1 * | 3/2005 | Sesto | A45F 5/02 224/269 |
| 2007/0192998 | A1 | 8/2007 | Ryder | |
| 2008/0087616 | A1 | 4/2008 | Weston | |
| 2010/0186149 | A1 | 7/2010 | Miller | |
| 2011/0094063 | A1 | 4/2011 | Dong | |
| 2014/0150167 | A1 * | 6/2014 | Mowad | A41F 9/00 2/337 |
| 2014/0250640 | A1 | 9/2014 | Crooks | |
| 2014/0305976 | A1 | 10/2014 | Stallworth | |
| 2015/0201689 | A1 | 7/2015 | Halbert | |
| 2018/0332915 | A1 * | 11/2018 | Salgado | A41F 17/02 |
| 2019/0069608 | A1 | 3/2019 | Halbert | |

FOREIGN PATENT DOCUMENTS

| | | | |
|---|---|---|---|
| GB | 190111535 | A | 7/1901 |
| JP | 3155230 | U | 11/2009 |
| JP | 2012224963 | A | 11/2012 |
| KR | 1020080039365 | A | 5/2008 |

* cited by examiner

SHIRT STAY WITH SUPPORT CLIP AND METHOD OF USING A SHIRT STAY

CROSS-REFERENCE TO RELATED APPLICATIONS

The present application claims benefit of Provisional Patent Application No. 62/897,375, filed on Sep. 8, 2019, entitled Shirt Stay—In/Pants Support Clip, that application being incorporated herein, by reference, in its entirety.

BACKGROUND OF THE INVENTION

Field of the Invention

The invention relates generally to a shirt stay for maintaining a shirt tail within a pair of pants or other bottoms, and a method for using the shirt stay. More particularly, in accordance with an embodiment of the invention, a shirt stay is provided that includes a support clip shared by both a top garment and a bottom garment (i.e., "bottoms"), and having opposing, U-shaped spring clips, to maintain the top garment within the bottoms.

Description of the Related Art

A majority of men and women wear shirts or blouses tucked into respective bottoms (e.g. shorts, pants, skirts, etc.). The shirt or blouse is neat, and when worn with dress-type bottoms, present a clean and professional look often utilized by white-collar workers in a professional work environment. However, when a user repeatedly stands up and sits down after wearing the above-described attire, the left and right waist parts of the top garment, as well as the front and back of the garment, naturally come loose from the user's bottoms, to the outside of a belt line in an untucked fashion. It is also very common that, for the same reason, pants slip down from the waistline even if supported by a belt. In order to prevent this from occurring, it is known in the prior art to line the inside of a user's bottoms or skirt with silicon tape. However, the left and right waist parts of the top garment eventually come loose out of the user's bottoms or skirt when the user moves, causing the user to repeatedly to re-tuck their top into theirs bottoms or skirt.

To solve the above-mentioned problem of silicon tapes failing to properly keep a top garment securely in place, Korean patent application publication No. 1020080039365 discloses a dress shirt or a T-shirt that is fixed using weight bodies, so that one end of the dress shirt or T-shirt is prevented from coming loose out of a user's bottoms, to the outside of a belt line. However, with the foregoing invention, the user's movements are substantially limited by the number of weight bodies affixed to the user's garment (i.e., "top"). The weight of these bodies causes a significant effect on the user, as gravity further weighs down the user's top. Accordingly, a problem still exists, where a top may come loose out of the user's bottoms, when light weight bodies are affixed to the user's top.

U.S. Pat. No. 9,084,448 B2 to Keum discloses a clip-shaped device for preventing tops from becoming untucked, where pants are fixed between an upper clip part and a lower clip part, and a belt is fixed between the upper clip part and a decorative cover element, while, at the same time, lower ends of the tops are fixed by a fixing member, thereby preventing the lower ends of the tops from being exposed to the outside of the bottoms. The use of a decorative cover element may not be a suitable solution for everybody wishing to prevent untucking of their tops.

What is needed is a shirt stay that is suitable to all users. What is additionally needed is a shirt stay having some flexibility in its gripping members, so as to hold a top securely tucked-in to the bottoms, without damaging the material to which it is attached. What is further needed is a shirt stay that permits interchanging of gripping elements to allow the tension applied to the garments to be varied, individually for the top garment and the bottom garment.

SUMMARY OF THE INVENTION

It is accordingly an object of the invention to provide shirt stay including a support clip, and a corresponding method of using the short stay that addresses the needs set forth above. In one particular embodiment of the invention, a shirt stay is provided with a dual gripping mechanism is provided for preventing a top from becoming untucked while simultaneously preventing pants from slipping down from the waist. In one particular preferred embodiment, the shirt stay includes an S-shaped or Z-shaped double clip, made up of two permanently interlocked U-shaped spring clips oriented in opposite directions and having interchangeable grips at the free ends of the spring legs, to adjust the spacing, and correspondingly, the spring tension, of the U-shaped spring clips.

In the above-described embodiment, the U-shaped spring clips are configured to hold a top garment and a bottom garment securely in place, relative to one another, when the springs are in a closed position. The spring tension of each U-shaped spring clip is adjusted by the interchangeable grips. In one particular embodiment, a kit is provided including a plurality of pairs of grips having differing characteristics from other pairs that are provided. In this embodiment, the user can select a varying degree of gripping force/spring force based on the type of clothing material and/or thickness that the user desires to secure.

The opposite facing U-shaped spring clips of the Z-shaped double-clip shirt stay of the present invention effectively prevents the bottom of a top garment from becoming untucked and exposed outside of the user's bottom garment, while simultaneously securing the user's bottom garment in place, thus achieving the effect that the user can have a comfortable and neat style of dress without the need to repeatedly readjust an exposed top garment back into the user's bottom garment.

Other features which are considered as characteristic for the invention are set forth in the drawings, description and appended claims.

Although the invention is illustrated and described herein as embodied in a shirt stay with support clip and a method for using a shirt stay, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which like reference numerals represent like items.

DETAILED DESCRIPTION OF THE INVENTION

For purposes of the present invention, note that, although the term "pants" is used generically herein to describe a bottom garment, to aid in the understanding of the invention. It should be understood that "pants" are merely one example of a type of bottoms with which the present invention can be used, and the term "pants" should be considered as being interchangeable with the terms "bottoms" and "bottom garment(s)". The invention is not meant to be limited only to its use with pants, but rather, may also be used with any other type of bottom garments, including, but not limited to, shorts, skirts, and undergarments. Similarly, the term "shirt" is used generically, herein, to describe an upper garment, and should be considered to also encompass any type of upper garment including, but not limited to, a dress shirt, blouse, t-shirt, polo, undershirt or chemise.

Figure 1C:
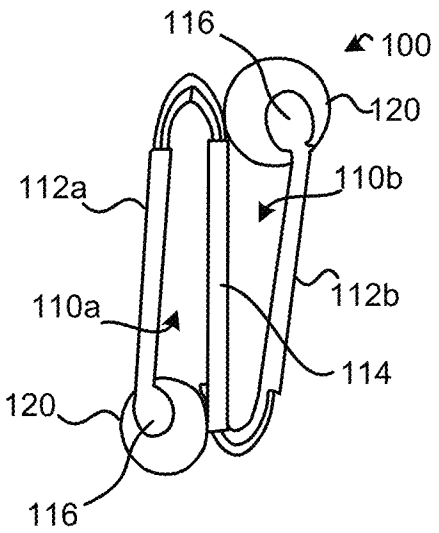
FIG. 1C is a side plan view of the shirt stay of FIG. 1A.
Figure 1B:
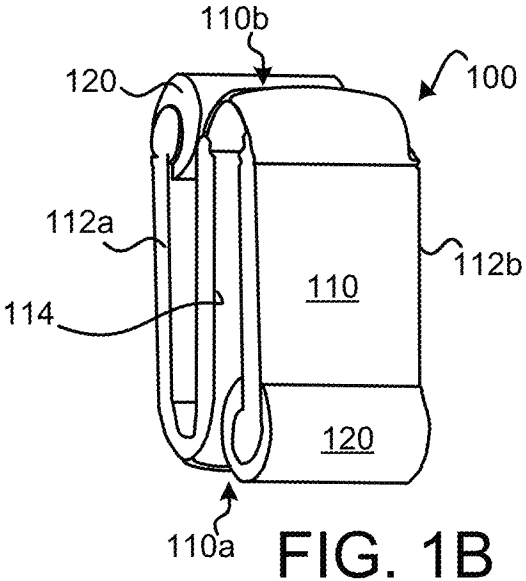
FIG. 1B is a side, perspective view of the shirt stay of FIG. 1A.
Figure 1A:
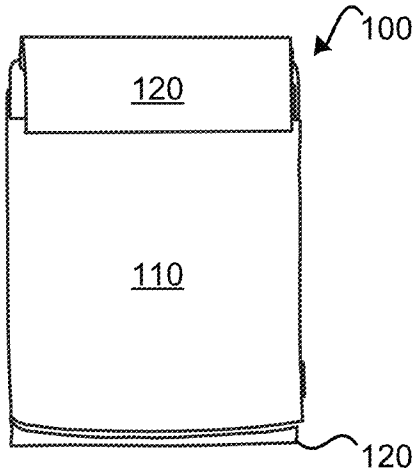
FIG. 1A is a front plan view of a shirt stay according to one particular embodiment of the invention.
Figure 2B:
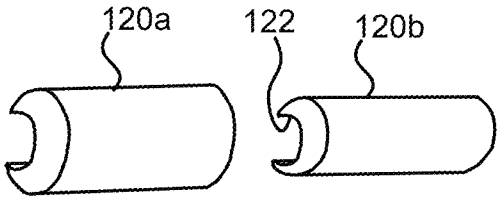
FIG. 2B is a partial perspective view of one of the spring members of the shirt stay of FIG. 1A, showing two possible, differently sized, interchangeable grips detached from the spring member, according to one particular embodiment of the invention.
Figure 2A:
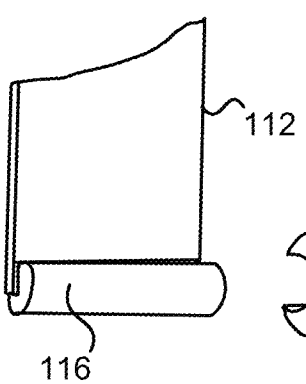
FIG. 2A is a partial perspective view of one of the spring members of the shirt stay of FIG. 1A, with an interchangeable grip attached, according to one particular embodiment of the invention.
Figure 2A:
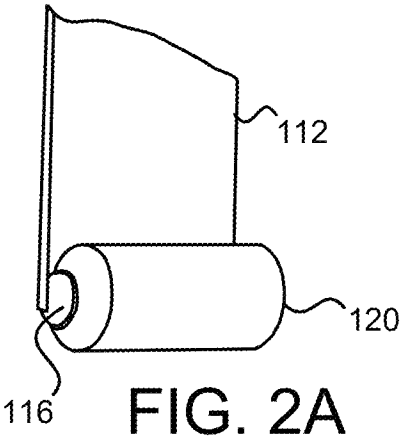

Referring now to FIGS. 1-2B of the drawings, there is shown a shirt stay 100 in accordance with one particular embodiment of the invention. The shirt stay 100 includes a support clip 110 and two gripping components or grips 120. Support clip 110 is a Z-shaped (or S-shaped) double clip formed as two oppositely facing, U-shaped spring clips 110*a* and 110*b*. One of the spring clips 110*a*, 110*b* acts as a pants or bottoms clip, while the other one of the spring clips 110*a*, 110*b* acts as shirt or tops clip.

The two U-shaped spring clips 110*a*, 110*b* open in opposite directions from one another. Each of the two U-shaped spring clips 110*a*, 110*b* comprises a permanently attached spring leg 112*a*, 112*b*, respectively, and shares a central spring body or member 114 in the middle, between them. For example, the spring leg 112*a* and central spring body 114, together, form the U-shaped spring clip 110*a*, while the spring leg 112*b* and central spring body 114, together, form the U-shaped spring clip 110*b*. The material in the area where each leg 112 is joined with the central spring body 114 is flexible, and/or thinned, so as to form a living hinge, while still having enough rigidity to maintain the clip 110 in an S- or Z-shape, as illustrated. As a consequence of the flexible joining area, the free end of each spring leg 112 can be forced away from the central spring body 114, to admit and entrap a portion of a garment therebetween. In one preferred embodiment, the support clip 110 is made from a rigid plastic material, thermoplastic, and/or an open cell foam.

In the preferred embodiment illustrated in FIGS. 1-2B, each spring leg 112 includes a bearing surface 116 disposed at the free end of the spring leg 112. The bearing surface 116 can be of any desired shape. In one particularly preferred embodiment, the bearing surface 116 is a substantially cylindrical projection extending from the spring leg 112, having a substantially circular cross-section. In another embodiment, the bearing surface 116 has an ovoid cross-section. This is not meant to be limiting, as the bearing surface 116 can be selected to have other cross-sectional shapes, as desired.

In accordance with one particularly preferred embodiment, additional frictional holding is provided by interchangeable gripping components or grips 120, which slide onto the bearing surfaces 116, at the free ends of each spring leg 112 of the support clip 112, and which are removable therefrom. In the embodiment illustrated, the grips 120 are configured as substantially cylindrical sleeves including a channel 122, sized to slide over the bearing surface, projection 116. In one embodiment of the invention, differently sized grips 120*a* and 120*b* are provided, and can be interchanged for one another on the bearing surfaces 116. For example, a grip 120*a*, 120*b* of a desired size can be selected by the user and slid (via the channel 122) over the bearing surface 116, where it is held in a frictional fit. Alternately, if desired each bearing surface 116 may include one or more channels with which one or more edges of the grip 120 can be engaged. Other solutions for adhering the grips 120 to the bearing surfaces 112 in a non-permanent fashion may be provided without departing from the scope and spirit of the present invention. In one particular embodiment of the invention, the grips 120 are made of a rubber and/or open-cell foam material.

In another embodiment of the invention, a shirt stay kit is provided to a user that includes one support clip 110 and a variety of interchangeable grips 120, including at least two pairs of grips 120, each pair being of different in some attribute than the other pair. For example, interchangeable grips 120 can be provided that have differing thicknesses, shapes, and frictional properties, each of which provides varying degrees of grip depending on the type of fabric that is to be secured. Thus, the present invention has the important feature that the user can select the appropriate grip 120*a* or 120*b* to place on the bearing surfaces of the legs 112*a* and 112*b*, based on the individual thicknesses and materials of the top and bottom garments. If desired, a differently sized grip 120 can be used on the bearing surface 116 of leg 112*a*, than is used on the bearing surface 116 of leg 112*b*.

In the present invention, the grips 120 act as spacers, changing the spacing between the leg members 112 and the body 114, by the addition of the grips of selected thicknesses at the ends of each spring leg 112. This allows the spring legs 112 to apply different spring tensions on the garments, so as to accommodate different fabric thicknesses and materials. More particularly, the interchangeable grips 120 provide an initial tension to the U-shaped spring clip 110*a* and 110*b*, by pushing spring legs 112 apart from the shared body 114 of the U-shaped spring clips 110*a*, 110*b*.

Figure 3A:
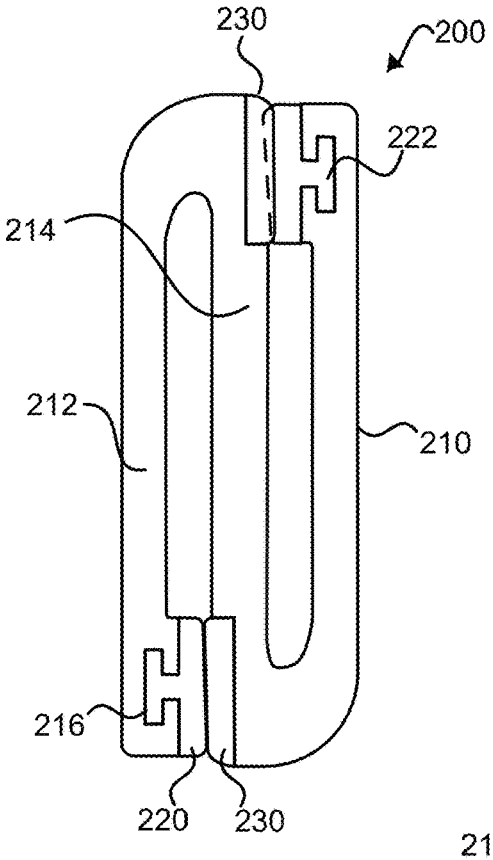
FIG. 3A is a side plan view of a shirt stay according to another embodiment of the present invention.
Figure 3B:
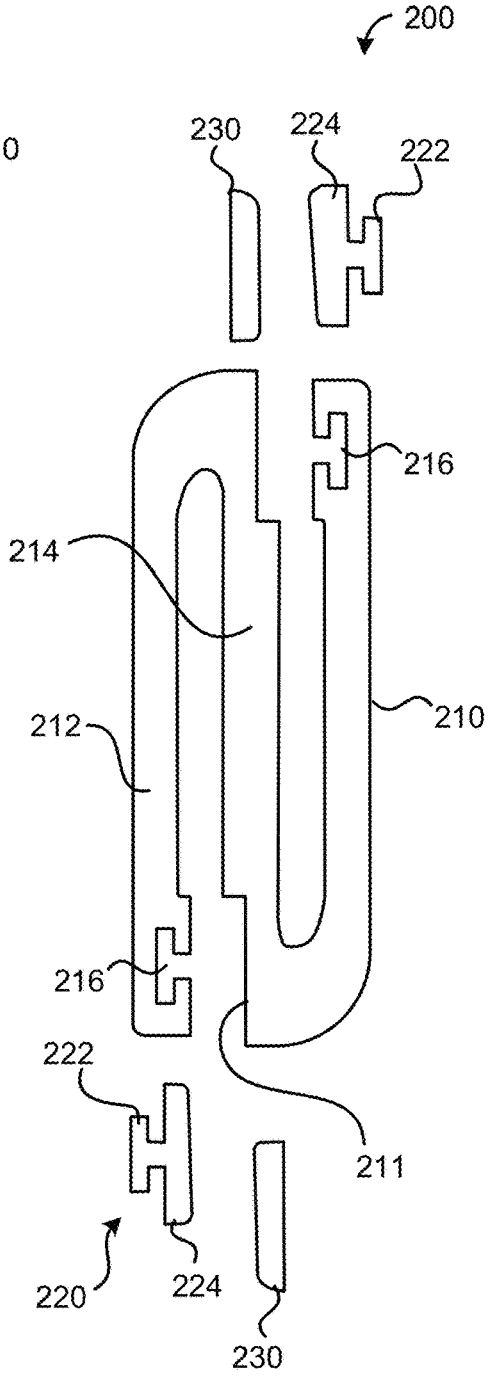
FIG. 3B is an exploded view of the shirt stay of FIG. 3A.
Figure 4C:
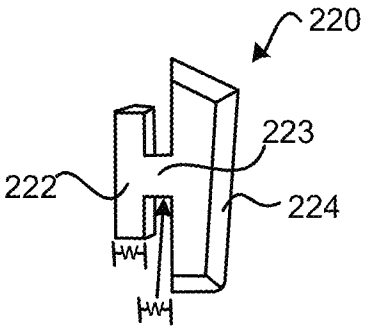
FIG. 4C is a side plan view of one particular embodiment of a grip or gripping component useful in one particular embodiment of the invention.
Figure 4B:
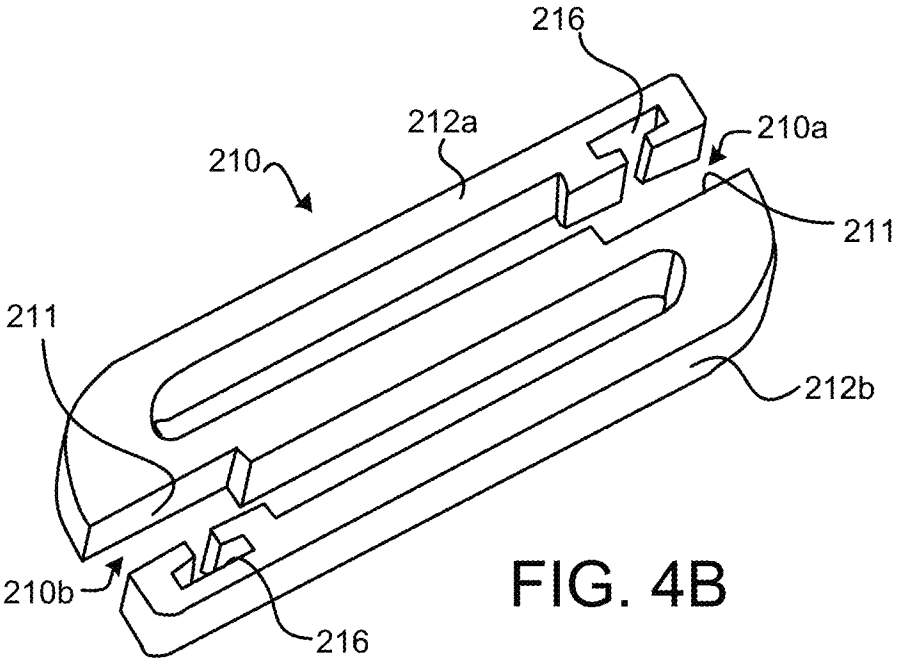
FIG. 4B is an isometric view, taken from the top of a support clip useful in one particular embodiment of the invention.
Figure 4A:
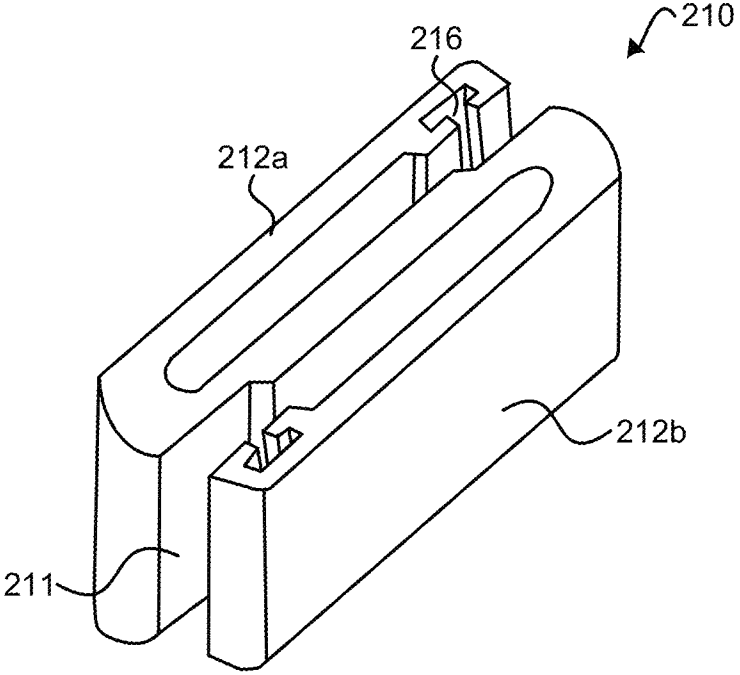
FIG. 4A is a perspective view of a support clip useful in one particular embodiment of the present invention.

Referring now to FIGS. 3A and 4C, another embodiment of a shirt stay device 200 is provided. The shirt stay 200 is substantially similar to the shirt stay 100 described above. For example, the shirt stay 200 includes an S-shaped or Z-shaped double clip, support clip 210 and two interchangeable gripping components or grips 220. Additionally, in the present preferred embodiment, additional grips 230 may optionally be provided, which are permanently affixed to cut-outs 211 formed in the support clip 210. In one particular embodiment of the invention, the grips 220 and 230 are made from at least one of a plastic, rubber and/or foam material, including an open-cell foam, as desired.

Also like the previous embodiment, the support clip 210 additionally includes two opposing, U-shaped spring clips 210*a* and 210*b*, which open opposite to one another. Each U-shaped spring clip 210*a*, 210*b* is formed by a spring leg 212 joined with a shared central spring body 214 by a flexible living hinge. However, rather than sliding over a bearing surface, as in the previous embodiment, the grips 220 engage bearing surfaces at the free ends of the spring legs 212*a*, 212*b* (i.e., the ends opposite the spring leg end joined to the shared, common central spring body 214) in an interlocking, tongue-and-groove or dovetailed fashion. For example, in the present embodiment, each spring leg 212 has at its free end a bearing surface including a groove or track 216 formed therein. Each grip 220 includes a tongue 222 shaped complementary to the groove 216, and a pad 224, which overlays the bearing surface at the end of the leg 212, when the tongue 222 is fully received in the groove 216 (as illustrated in FIG. 3A). In the present embodiment, the tongue 222 is slidable within the groove 216, to seat the pad 224 on a bearing surface on the free end of each spring leg 212. The grip 220 is also removable from the free end of the spring leg 212 by sliding the tongue 222 out of the groove 216, by pushing the pad 224 out of contact with the bearing surface. Note that this configuration is exemplary, and not meant to limit the invention only to this embodiment. It can be seen that the invention would additionally work if the tongue was on the bearing surface of the leg 212, and the groove on the grip 220; or even if some other configuration were used, such as a post and hole configuration (i.e., a post on the bearing surface and a hole in the pad 224, or vice-versa). It should be understood that further configurations for interchangeably adhering the pad 224 to a bearing surface of the leg 212, can be used without departing from the scope and spirit of the present invention.

As described in connection with the previous embodiments, the support clip 210 can be provided as part of a kit that includes a plurality of different grips 220 that are interlockable with, and removable from, the bearing surface of the free end of the spring legs 212. Additionally, the different grips 220 of the kit can have different characteristics from one another, such as differing thicknesses, shapes, and frictional properties, to permit varying degrees of grip to be selected depending on the type of fabric that is to be secured. In a preferred embodiment, the kit is provided with pairs of grips 220 having pads of different thicknesses, so that the grips 220 will act as spacers, changing the spacing between the leg members 212 and the body 214, by the addition of the grips 220 having pads 224 of selected thicknesses at the ends of each spring leg 212.

In one particular embodiment of the invention, each tongue 222 has a width w of about 3.0 mm, to correspond to a complementary width of the groove 216. In that embodiment, a neck 223, disposed between the tongue 222 and pad 224 has a width w of about 3.0 mm to correspond to a complementary portion of the groove 216. In use, the interchangeable grips 220 are disposed opposite the permanent grips 230 and, due to the spring force of each U-shaped spring 210*a*, 210*b*, apply a force to one another. In other words, the pad 224 of each grip 220 presses against the grip 230, due to the spring force of the device. Both the grips 220 and the grips 230 should be selected from a material that applies a frictional gripping force to a fabric gripped therebetween. The support clip 210, itself, can be made from a rigid plastic material, thermoplastic and/or an open cell foam.

Figure 5A:
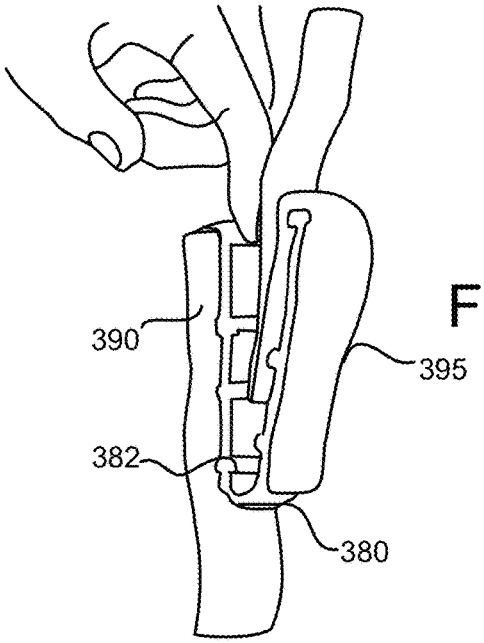
FIG. 5A is a perspective view of a shirt stay according to another embodiment of the invention, in use.
Figure 5B:
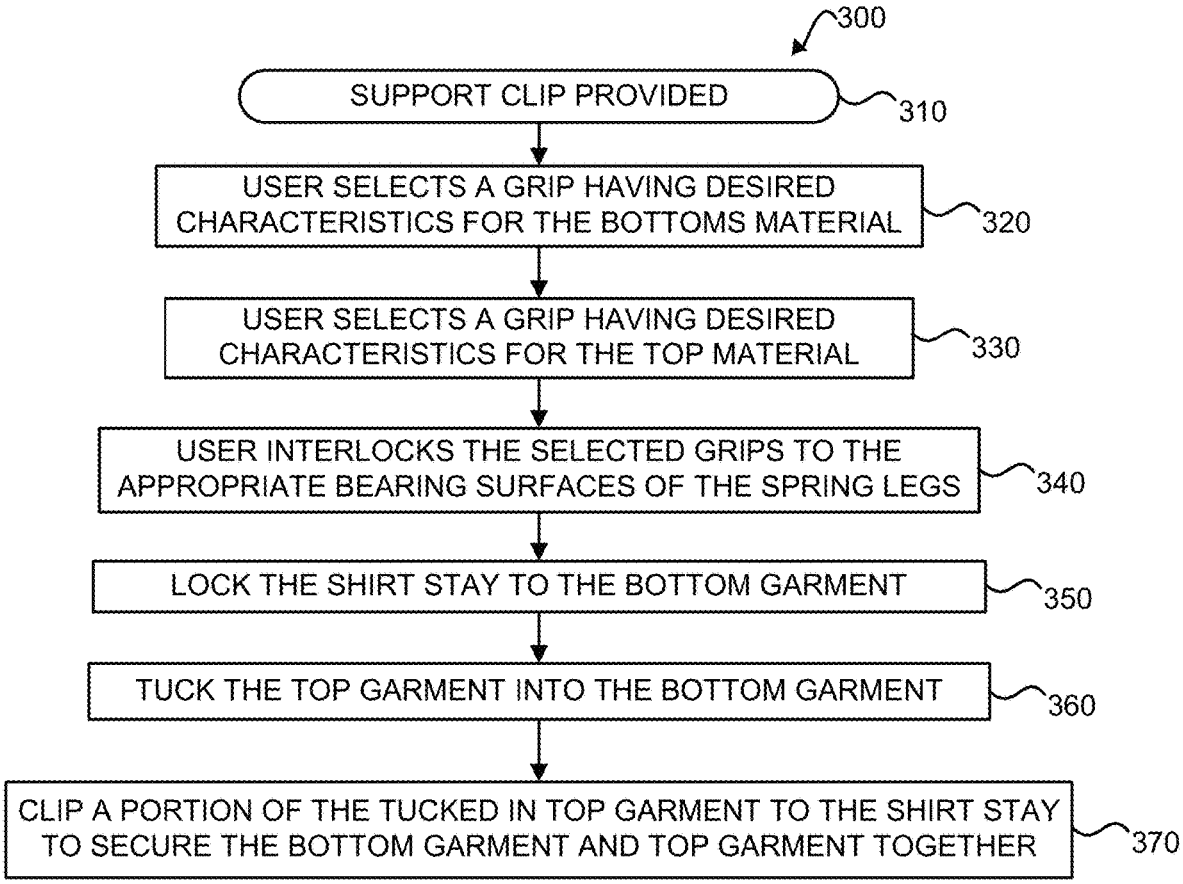
FIG. 5B is a simplified flow diagram of a method for using a shirt stay in accordance with one particular embodiment of the present invention.

Referring now to FIGS. 5A and 5B, a method 300 of using a shirt stay 380, will now be described. First, a support clip is provided. Step 310. The support clip can be of a type described in connection with FIGS. 1-4C, or may be another type of support clip. In the embodiment illustrated in FIG. 5A, the support clip of the shirt stay 380 additionally includes ridges 382 inside each U-shaped spring, to apply an additional frictional force component to the garment trapped therein.

Prior to applying the support clip to a garment, a user selects a grip having the desired characteristics based on the characteristics of the bottoms material. Step 320. For example, the user selects a grip having a thickness or frictional hold, based on the thickness or type of material used in the bottom garment. A grip having desired characteristics for use with the top material is similarly selected by the user. Step 330.

The user then interlocks the selected grips to the appropriate bearing surfaces of the spring legs of the support clip. Step 340. For example, the grip can be slid over a bearing surface, as described in connection with FIG. 2A, or interlocked in a tongue-and-groove fashion as described in connection with FIGS. 3A-4C. Alternately, a grip pad can be adhered to a bearing surface of the spring legs in another way, without departing from the scope or spirit of the present invention. As discussed above, the interchangeable grips are used to provide initial tension to the U-shaped spring clips, through the selection of grips having a particular thickness, shape, and frictional property depending on the type and/or thickness of fabric that is to be secured.

The shirt stay 380, with the grips attached, is then locked to the bottom garment. Step 350. This is done by orienting the shirt stay 380 with a downwardly facing U-shaped spring over the waistband 390 of the bottom garment, and pushing the clip down over the top of a waistband 390, with the upwardly facing U-shaped clip pointed into the bottoms (i.e., towards the user). The waistband 390 of the bottom garment should then be locked between the spring leg and central spring body of the downwardly facing U-shaped clip of the shirt stay 380.

With the shirt stay 380 affixed to the waistband of the bottom garment in the orientation described above, and illustrated in FIG. 5A, the upwardly facing U-shaped clip of the shirt stay 380 is oriented to hold, in its closed position, a tucked-in piece of the top garment 395. The top garment is then tucked into the bottom garment. Step 360.

Then, as illustrated in FIG. 5A, the free end of the spring leg of the upwardly facing U-shaped spring is pushed back with the finger of the user, to open the upwardly facing U-shaped spring. Once open, a piece of the top garment 395 is pushed down into the open groove between the spring leg and central spring body of the upwardly facing U-shaped spring. When the user's finger is removed, the U-shape spring snaps closed, securely entrapping the top garment. Step 370. While in this closed position, the shirt stay 380 binds together a bottom garment, such as a pair of pants, and a top garment, to prevent their separation while the user is moving, or stretching or changing body positions (i.e. sitting, bending, etc).

Accordingly, while a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

I claim:

1. A shirt stay, comprising:

a support clip including:

a first U-shaped spring clip, including:

a common central spring body;

a first spring leg that is free at one end and, at an opposite end, is fixed to a first end of said common central spring body;

a second U-shaped spring clip, including:

said common central spring body;

a second spring leg that is free at one end and, at an opposite end, is fixed to a second end of said common central spring body that is opposite from said first end of said common central spring body;

said first U-shaped spring clip and said second U-shaped spring clip opening in opposite directions;

a first grip removably attached to the free end of said first spring leg, between said first spring leg and said common central spring body; and a second grip removably attached to the free end of said second spring leg, between said second spring leg and said common central spring body.

2. The shirt stay of claim 1, wherein said first spring leg includes a first bearing surface at its free end, and said second spring leg includes a second bearing surface at its free end, said first grip being removably attached to said first bearing surface, and said second grip being removably attached to said second bearing surface.

3. The shirt stay of claim 2, wherein said first bearing surface includes a first projection extending from said first spring leg, and said first grip is configured to slide over said first projection.

4. The shirt stay of claim 3, wherein said first projection is substantially cylindrical.

5. The shirt stay of claim 2, wherein said first projection includes one of a tongue or a groove and said first grip includes the other one of a tongue or a groove, said tongue being configured to mate with said groove, in order to seat a portion of said grip on said first bearing surface.

6. The shirt stay of claim 2, wherein a portion of said support clip is flexible where said first spring leg is joined to said common central spring body, and said first grip is selected to define a distance between the free end of said first spring leg and said common central spring body, and a corresponding spring tension of said first spring leg.

7. The shirt stay of claim 6, wherein a portion of said support clip is flexible where said second spring leg is joined to said common central spring body, and said second grip is selected to define a distance between the free end of said second spring leg and said common central spring body, and a corresponding spring tension of said second spring leg.

8. The shirt stay of claim 7, wherein said first grip is selected to be the same size as said second grip.

9. The shirt stay of claim 7, wherein said first grip is selected to be a different size from said second grip.

10. A shirt stay kit, comprising a support clip including:

a first U-shaped spring clip, including:

a common central spring body;

a first spring leg that is free at one end and, at an opposite end, is fixed to a first end of said common central spring body;

a second U-shaped spring clip, including:

said common central spring body;

a second spring leg that is free at one end and, at an opposite end, is fixed to a second end of said common central spring body that is opposite from said first end of said common central spring body;

said first U-shaped spring clip and said second U-shaped spring clip opening in opposite directions;

a plurality of grips configured to be removably attached to the free end of said first spring leg or said second spring leg, between said respective first spring leg or second spring leg and said common central spring body; and said plurality of grips including at least two grips having at least one different characteristic from one another.

11. The shirt stay kit of claim 10, wherein said at least one different characteristic is selected from the group consisting of: thickness, shape and frictional properties.

12. The shirt stay kit of claim 10, wherein said plurality of grips includes at least a first pair of grips and a second pair of grips, said first pair of grips having at least one characteristic that differs from a characteristic of said second set of grips.

13. The shirt stay kit of claim 10, wherein each grip of said plurality of grips is configured to be interchangeable with one another, and to slide over a bearing surface of the spring leg.

14. The shirt stay kit of claim 10, wherein each grip of said plurality of grips is configured to be interchangeable with one another and includes one of a tongue or a groove configured to interlock with a complementary other one of a tongue or a groove of a bearing surface of the spring leg.

15. The shirt stay kit of claim 10, wherein said plurality of grips includes grips of various sizes configured to provide at least one of a varying tension or friction to a U-shaped spring clip of said support clip.

16. A method of using a shirt stay to prevent a top garment from becoming untucked from a bottom garment:

providing a support clip including:

a first U-shaped spring clip, including:

a common central spring body;

a first spring leg that is free at one end and, at an opposite end, is fixed to a first end of said common central spring body;

a second U-shaped spring clip, including:

said common central spring body;

a second spring leg that is free at one end and, at an opposite end, is fixed to a second end of said common central spring body that is opposite from said first end of said common central spring body;

said first U-shaped spring clip and said second U-shaped spring clip opening in opposite directions;

selecting a first grip based on at least one of a thickness or a material type of a bottom garment;

selecting a second grip based on at least one of a thickness or a material type of a top garment;

placing the first grip on a bearing surface of the first spring leg;

placing the second grip on a bearing surface of the second spring leg;

pushing the first U-shaped spring clip down over a portion of the bottom garment; and subsequently, tucking a portion of the top garment into said second U-shaped clip.

17. The method of claim 16, wherein said first grip is selected to have at least one different characteristic from said second grip.

18. The shirt stay kit of claim 17, wherein said at least one different characteristic is selected from the group consisting of: thickness, shape and frictional properties.

19. The method of claim 16, wherein said first grip is selected to have the same characteristics as said second grip.

20. The method of claim 16, wherein said first and second grips are selected from a plurality of grips provided in a kit with said support clip, each grip of said plurality of grips having at least one different characteristic than at least one other grip of said plurality of grips, and said first and second grips are selected from said plurality of grips based on a desired spring tension or friction.

* * * * *